United States Patent [19]

Bjerke

[11] 4,162,137

[45] Jul. 24, 1979

[54] SUBMERSIBLE, HYDRAULICALLY-DRIVEN PUMP ROTATING ABOUT A VERTICAL AXIS

[75] Inventor: Leiv Bjerke, Oslo, Norway

[73] Assignee: Thune-Eureka A/S, Tranby, Norway

[21] Appl. No.: 832,412

[22] Filed: Sep. 12, 1977

[30] Foreign Application Priority Data

Oct. 21, 1976 [NO] Norway ..... 763590

[51] Int. Cl.[2] ..... F04B 17/00

[52] U.S. Cl. ..... 417/405; 277/59

[58] Field of Search ..... 417/405, 406, 407, 421, 417/424; 277/3, 15, 27, 59; 184/65

[56] References Cited

U.S. PATENT DOCUMENTS

| | | | |
|---|---|---|---|
| 1,734,458 | 11/1929 | Allen | 277/59 X |
| 1,905,527 | 4/1933 | Thomas et al. | 184/65 X |
| 2,149,600 | 3/1939 | Guinard | 417/406 X |
| 2,337,849 | 12/1943 | Dubrovin | 418/2 X |
| 2,743,673 | 5/1956 | Kaatz et al. | 417/424 |
| 3,157,128 | 11/1964 | Hustinx | 417/421 X |

FOREIGN PATENT DOCUMENTS 2618951 11/1976 Fed. Rep. of Germany ..... 417/405

*Primary Examiner*—Carlton R. Croyle
*Assistant Examiner*—Michael Koczo, Jr.
*Attorney, Agent, or Firm*—Young & Thompson

[57] ABSTRACT

A submersible, hydraulically-driven pump rotating about a vertical axis, the pump having a short shaft between the hydraulic motor and the impeller of the pump. A cofferdam is placed around the hydraulic pipe and the hydraulic motor, extending from the pump housing to up above the cargo level, with a shaft sealing arrangement being provided between the motor and impeller. The cofferdam is formed as three consecutive chambers around the shaft, extending between the hydraulic motor and the impeller, whereby the upper, first chamber is a receptacle for oil leakage from the hydraulic motor, and the next, second chamber contains a sealing liquid under pressure and is sealed at the top and at the bottom by respective mechanical shaft seals against the upper, first chamber and the lower, third chamber, respectively.

6 Claims, 2 Drawing Figures

SUBMERSIBLE, HYDRAULICALLY-DRIVEN PUMP ROTATING ABOUT A VERTICAL AXIS

Figure 1:
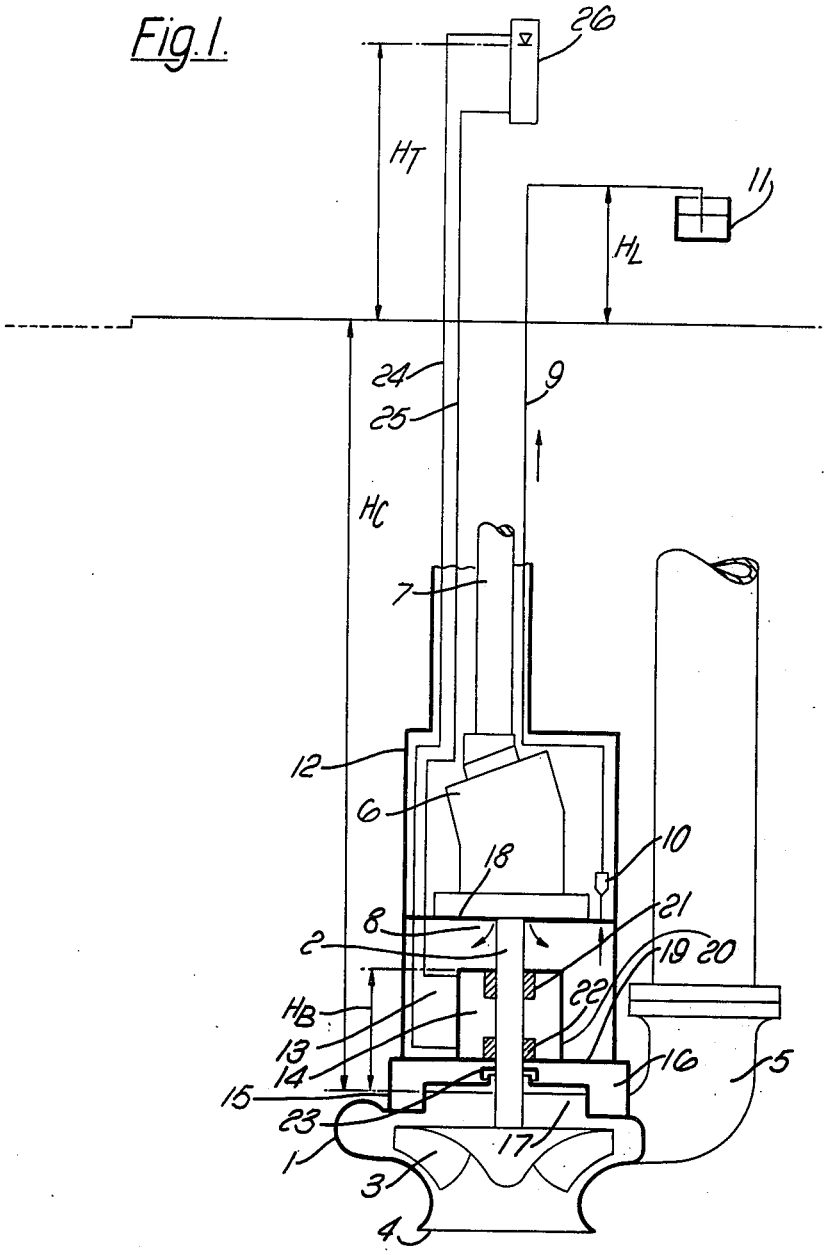

The invention relates to a submersible, hydraulically-driven pump rotating about a vertical axis, the pump having a short shaft between the hydraulic motor and the impeller of the pump, wherein a cofferdam is disposed around the hydraulic pipes and the hydraulic motor, extending from the pump housing and up above cargo level, with a shaft sealing arrangement between the motor and impeller.

In a submersible, hydraulically-driven pump, it is very important that there be no leakage of hydraulic oil out into the cargo, nor any leakage of cargo into the hydraulic system. This is particularly important when the cargo is of such a nature that possible leakage could lead to dangerous chemical reactions, or result in contamination of valuable cargo, thus rendering it unusable.

It is known to arrange a cofferdam or a protective pipe around all of the hydraulic pipes and around the hydraulic motor. The cofferdam, which extends all the way down to the pump housing, protects the hydraulic components from any aggressive liquids, while at the same time it assures that any leakage of hydraulic oil will be collected and contained without any opportunity of its contaminating the cargo.

The shaft between the motor and impeller must be sealed, and several suitable sealing arrangements for this purpose are known. Thus, it is known to provide a special chamber around the shaft which is sealed off by means of mechanical seals which cooperate with the shaft, this chamber thus forming a barrier between the space containing the hydraulic oil and the cargo. The barrier chamber can then be put under pressure or suction. The barrier chamber can also be filled with a sealing liquid.

It is also known to utilize the diving bell principle, whereby the lower part of the cofferdam, that facing toward the cargo, is formed like a diving bell, open at the bottom; the cargo, rising up into the bell, compresses gas, thereby establishing a counterpressure which prevents the cargo from further penetration.

The primary aim of the present invention is to combine the sealing-liquid system and the use of the diving bell principle, such that one obtains a double safeguard against any mixing whatsoever of hydraulic oil, and cargo, while at the same time providing a sealing system which is simple in construction and maintenance and which does not require special, complicated equipment, for example, for stopping leakage.

This object is achieved through the provision of three chambers between the hydraulic motor and the pumping unit itself. The uppermost chamber, the leakage chamber, will collect oil leakage from the hydraulic motor. The leaked oil is returned to the hydraulic tank through a pipe provided for that purpose. The next chamber, the sealing liquid chamber, is sealed against the shaft both at the top and at the bottom by means of two mechanical seals. The upper shaft seal closes against oil leakage from the hydraulic motor, and the lower shaft seal closes against the third chamber, the diving bell chamber. The sealing liquid chamber is connected via two pipes to a level indicator glass positioned above cargo level. By completely filling the level indicator glass with sealing liquid, the sealing liquid chamber will be placed under pressure, while at the same time one obtains an indication of sealing system conditions, because the level in the gauge will change if there should be any leakage in the sealing liquid system. The lower chamber is formed as a two-part diving bell, the chamber being subdivided into a collection chamber and a compression chamber. The compression chamber is in direct contact with the cargo at the bottom, while its upper end has an open connection with the collection chamber and together with the collection chamber is sealed against the sealing liquid chamber by means of said lower mechanical seal. When cargo is filled in the tank where the pump is arranged, the cargo will attempt to penetrate up into the diving bell chamber as the cargo level rises. However, this will cause the gas contained within the diving bell to be compressed, thus setting up a constant counterpressure which prevents further penetration of cargo into the diving bell. The compression chamber and collection chamber are constructed such that even when the tank is filled with cargo, it is not possible for the cargo to penetrate up so high that it can come into the collection chamber. The collection chamber will always be empty, therefore, so that it is always available to collect sealing liquid, which would leak out should the lower mechanical seal on the shaft fail. The collection chamber is dimensioned such that it is capable of containing the entire amount of liquid. In this way, two safeguards against contamination of the cargo are provided. In order for the cargo to be able to penetrate into the sealing liquid chamber, first the diving bell and subsequently the lower mechanical seal on the shaft would have to fail. There are thus two safeguards against mixing of cargo and hydraulic oil. The diving bell principle can in some cases be unsuitable, e.g., when the cargo is of an especially explosure nature. For such cargo, it is essential that there be no air pockets in the cargo tanks, and in order to avoid air pockets, one would have to remove all air from the diving bell. This would complicate the construction. According to the invention, one may avoid this problem by providing a seal against the cargo for the third (lower) chamber, in which case the compression chamber will be eliminated. This seal will also serve as an extra safety device, as the closed-off third chamber will work like an ordinary diving bell if the seal should become worn down.

According to the invention, therefore, an arrangement is provided for a submersible, hydraulically-driven pump rotating about a short shaft between the hydraulic motor and the pump impeller, wherein a cofferdam is provided around the hydraulic pipes and the hydraulic motor, extending from the pump housing and up above the level of the cargo, with a shaft sealing arrangement being provided between the motor and impeller, and that which characterizes the arrangement is that the cofferdam is formed as three consecutive chambers around the shaft between the hydraulic motor and the impeller of the pump, where the upper, first chamber collects oil leakage from the hydraulic motor, and the second, middle chamber contains a sealing liquid under pressure and is sealed at the top and at the bottom by, respectively, one mechanical shaft seal against the upper, first chamber and one mechanical shaft seal against the third, lower chamber. The third, lower chamber is preferably formed as a diving bell which is divided into an upper collection chamber and a lower compression chamber which is open toward the cargo at the bottom, the collection chamber being capable of catching and containing the entire amount of sealing liquid leakage through said lower shaft seal and having an open connection with the upper part of the compression chamber.

Preferably, the second, sealing liquid chamber is connected by means of two pipes to a level indicator glass which is positioned above cargo level.

In a practical structural embodiment, the upper, first chamber extends down around the second chamber, such that oil leakage in the first chamber thereby surrounds the sealing liquid chamber and the shaft seals and effects cooling of these components. Preferably, the collection chamber extends down around the compression chamber, such that one obtains a compact method of construction for the whole pump. Under special circumstances, as mentioned above, the third chamber can be provided with a seal against the cargo.

The invention will be further explained with reference to the drawings, wherein

Figure 2:
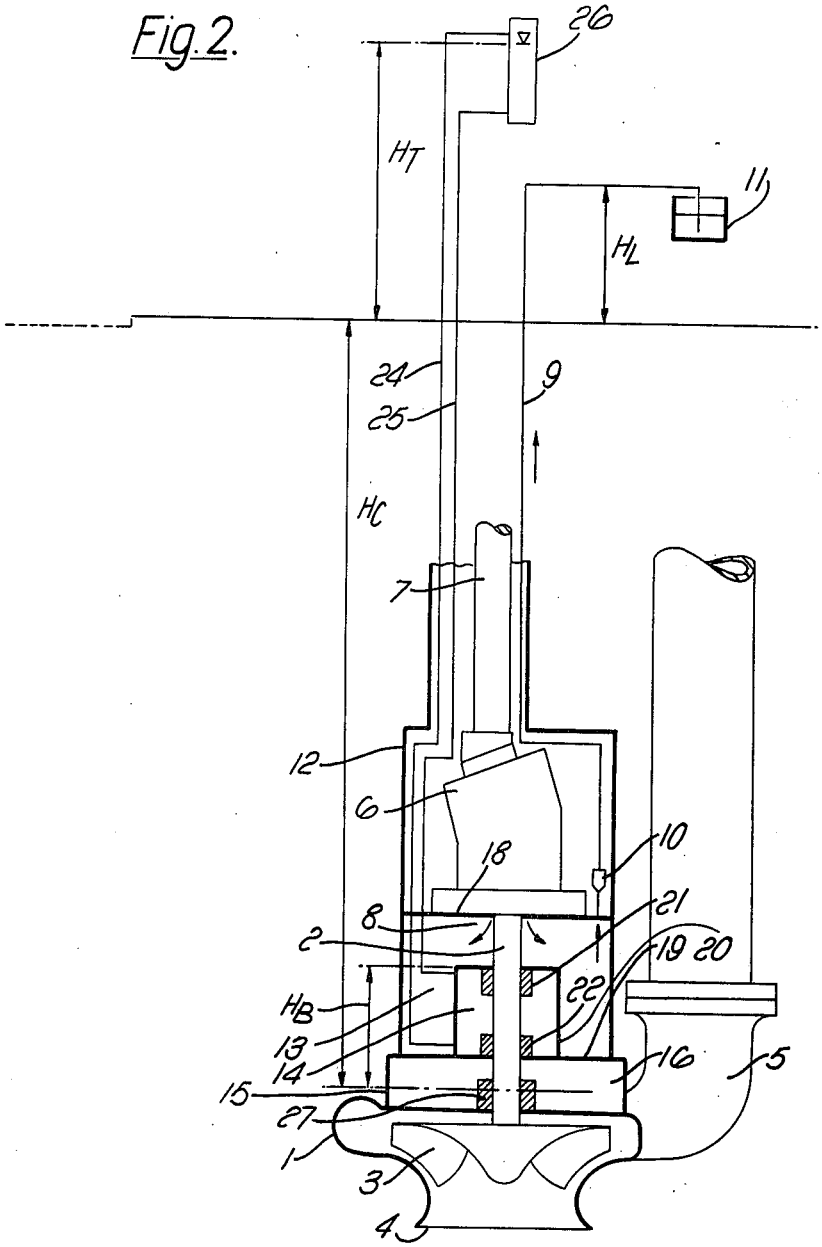

FIG. 1 shows a schematic cross section through a submersible pump provided with the arrangement according to the invention, and FIG. 2 shows, schematically and in cross section, a modified embodiment of the pump.

In FIG. 1, the pump housing for a centrifugal pump is designated 1. In the pump house 1, an impeller 3 is mounted rotatable about a shaft 2. The pump housing intake is designated by 4, and its outlet and riser pipe, 5.

The shaft 2 leads out from a hydraulic motor 6. Hydraulic oil is supplied to the motor through the pipe 7. Oil leakage from the motor leaks out at the shaft 2 as indicated by the arrows 8 and is led up to a level above cargo level through a conduit 9 past a check valve 10. The conduit 9 leads up to the hydraulic tank 11. A cofferdam 12 extends up from the pump housing 1 to above cargo level, e.g. to above the deck when the pump is used on a ship, and surrounds the hydraulic pipes and any other conduits which one wishes to lead down to the pump unit.

In the area of the pump unit, the cofferdam is divided into three chambers, viz., an oil leakage chamber 13, a sealing liquid chamber 14 and a diving bell chamber 15. The diving bell chamber is subdivided into a collection chamber 16 and a compression chamber 17.

At the top, the oil leakage chamber 13 is delimited by a transverse wall 18, and at the bottom by a transverse wall 19 and by a wall 20 of the sealing liquid chamber 14. The sealing liquid chamber is sealed at the top by a mechanical shaft seal 21 and at the bottom by a mechanical shaft seal 22. A discharge ring 23 is mounted on the shaft 2 in the collection chamber 16.

Via two thin pipes 24, 25, the sealing liquid chamber is connected to a level indicator glass 26 above cargo level. In this way, the sealing liquid is held under pressure in the chamber 14.

In FIG. 1, the pump is shown submerged. Cargo has penetrated up into the compression chamber 17 and gas enclosed in the diving bell has been compressed, such that the resulting counterpressure prevents further intrusion of the cargo into the diving bell. The compression chamber 17 and collection chamber 16 are made such that even when the tank is full, the cargo has no possibility of penetrating to so high a level that it can enter the collection chamber 16. This chamber will thus always be empty, so that it is prepared at all times to collect and contain sealing liquid if the lower mechanical shaft seal 22 should malfunction. The collection chamber 16 is dimensioned such that it is capable of containing the entire amount of sealing liquid. In this way, a double safeguard against contamination of the cargo is provided.

In order for the cargo to penetrate into the sealing liquid chamber 14, first the diving bell must fail, and thereafter the lower mechanical shaft seal 22, and it is this arrangement which provides the double safeguard against any intermixture of cargo and hydraulic oil.

The pressure conditions of the three chambers 13, 14 and 15 are of importance to the question of leakage between the chambers, because leakage would be possible only from a chamber having a higher pressure than the surroundings.

For the leakage chamber 13, one has two alternatives with regard to pressure level, i.e., when the hydraulic system is in operation and when it is not. When the latter is the case, one can assume that there will be no overpressure in the leakage chamber because the check valve 10 closes while at the same time the oil will contract slightly as it cools. It should be mentioned here that the operating temperature for the hydraulic oil will be about 60° C.

When the pump is in operation, oil leakage will flow into the oil leakage chamber 13. The check valve 10 will open and the oil will flow up to the deck and back into the hydraulic tank 11. The pressure in the chamber 13 will thus be the sum of the pressure loss over the check valve $\Delta P_C$, the friction loss in the conduit $\Delta P_F$, and the static height up to the feed tank (pressure head), i.e., $\gamma(H_L+H_C-H_B)$, where $\gamma$ is the density of the leaked oil.

In the sealing liquid chamber 14, the pressure will be equal to the static pressure on condition that the chamber is tight and that the liquid has the opportunity to expand if it is heated. The pressure here will be equal to $\gamma B(H_T+H_C-\frac{1}{2}\ H_B)$, where $\gamma B$=the density of the sealing liquid.

In the diving bell chamber, the pressure will be equal to the static pressure in the surrounding cargo, or $\gamma_C \cdot H_C$, where $\gamma_C$=the density of the cargo.

Therefore, when there is cargo in the tank, the pressure difference between the sealing liquid and the diving bell chambers will be small, and if leakage should occur either the one way or the other, one could quickly reach pressure equalization, which would prevent further leakage.

The same is true of the pressure conditions between the oil leakage and the sealing liquid chambers, provided the hydraulic system is in operation. In the non-operational state, any leakage that does occur will be out of the sealing liquid chamber. This in turn will be registered in the level indicator glass, indicating that the sealing system should be inspected.

The pump embodiment illustrated in FIG. 2 is fundamentally the same as the embodiment of FIG. 1, and the same reference numerals are therefore used for corresponding parts. The only difference from FIG. 1 is that the third chamber 15 is formed as an ordinary chamber around the shaft 2, the chamber then being sealed against the cargo by a shaft seal 27. This special pump embodiment is used to advantage with cargoes that are especially explosive, where it is essential that there be no air pockets in the cargo tank.

Having described my invention, I claim:

1. In a cargo vessel, a submersible, hydraulically-driven pump rotating about a vertical axis, the pump having a housing and a hydraulic motor and an impeller and a short shaft between the hydraulic motor and the impeller and a hydraulic pipe feeding the motor, a cofferdam around the hydraulic pipe and the hydraulic motor, extending from the pump housing to up above the cargo level in the vessel, and a shaft seal between the motor and impeller; the improvement in which the cofferdam is formed as three consecutive chambers around the shaft, extending between the hydraulic motor and the impeller, whereby the upper, first chamber is a receptacle for oil leakage from the hydraulic motor, and the next, second chamber contains a sealing liquid under pressure and is sealed at the top and at the bottom by respective mechanical shaft seals against the upper, first chamber and the lower, third chamber, respectively.

2. The arrangement according to claim 1, in which the lower, third chamber is formed as a diving bell which is subdivided into a collection chamber and a compression chamber which is open toward the cargo at the bottom, said collection chamber being capable of collecting and containing a leakage of the entire amount of sealing liquid through said lower mechanical shaft seal and having an open connection with the upper part of the compression chamber.

3. The arrangement according to claim 2, in which the collection chamber extends down around the compression chamber.

4. The arrangement according to claim 1, and a shaft seal by which the third chamber is sealed against the cargo.

5. The arrangement according to claim 1, and a level indicator glass positioned above cargo level, and two pipes by which the second chamber is connected to the level indicator glass.

6. The arrangement according to claim 1, in which the upper, first chamber extends down around the second chamber.

* * * * *